US011014739B2

(12) United States Patent
Kokoschka

(10) Patent No.: US 11,014,739 B2
(45) Date of Patent: May 25, 2021

(54) COVER ASSEMBLY

(71) Applicant: Caterpillar Energy Solutions GmbH, Mannheim (DE)

(72) Inventor: Benno Kokoschka, Karlsruhe (DE)

(73) Assignee: Caterpillar Energy Solutions GmbH, Mannheim (DE)

( * ) Notice: Subject to any disclaimer, the term of this patent is extended or adjusted under 35 U.S.C. 154(b) by 656 days.

(21) Appl. No.: 15/378,910

(22) Filed: Dec. 14, 2016

(65) Prior Publication Data

US 2017/0174420 A1 Jun. 22, 2017

(30) Foreign Application Priority Data

Dec. 17, 2015 (GB) ..... 1522249

(51) Int. Cl.

| | |
|---|---|
| ***B65D 88/02*** | (2006.01) |
| ***E04B 1/68*** | (2006.01) |
| ***B65D 90/00*** | (2006.01) |
| ***E04B 1/348*** | (2006.01) |
| ***B65D 85/68*** | (2006.01) |
| ***B65D 88/12*** | (2006.01) |

(52) U.S. Cl.

CPC ..... *B65D 88/027* (2013.01); *B65D 85/68* (2013.01); *B65D 88/12* (2013.01); *B65D 90/0006* (2013.01); *E04B 1/3483* (2013.01); *E04B 1/34861* (2013.01); *E04B 1/6803* (2013.01); *B65D 2585/6877* (2013.01); *E04B 2001/34884* (2013.01)

(58) Field of Classification Search

CPC ..... B65D 88/124; B65D 90/0006; B65D 88/027; E04B 1/3483; E04B 1/34846; E04B 1/6815

USPC ..... 220/23.2

See application file for complete search history.

(56) References Cited

U.S. PATENT DOCUMENTS

| | | | | |
|---|---|---|---|---|
| 3,599,824 | A * | 8/1971 | Pneuman | B65D 90/0006 220/23.4 |
| 3,949,727 | A | 4/1976 | Thien et al. | |
| 4,771,871 | A * | 9/1988 | Lambracht | A45C 5/14 190/1 |
| 4,794,206 | A | 12/1988 | Weinstein | |
| 7,337,760 | B2 | 3/2008 | Digregorio | |

FOREIGN PATENT DOCUMENTS

| | | |
|---|---|---|
| CN | 201010099 | 1/2008 |
| CN | 203601804 | 5/2014 |
| GB | 744723 | 2/1956 |
| RU | 2170855 | 7/2001 |
| WO | 2004076762 | 9/2004 |

OTHER PUBLICATIONS

Search Report dated Jun. 27, 2016, issued in GB 1522249.0 (1 page).

* cited by examiner

*Primary Examiner* — Anthony D Stashick
*Assistant Examiner* — Raven Collins

(57) ABSTRACT

A cover assembly is disclosed. The cover assembly may cover a gap between a first container and a second container. The cover assembly may have a first rigid element. The cover assembly may also have a second rigid element. Further, the cover assembly may have an elastic body. The elastic body may be positioned between the first rigid element and the second rigid element. The cover assembly may also have a bolt. The bolt may connect the first rigid element with the second rigid element.

9 Claims, 5 Drawing Sheets

COVER ASSEMBLY

CLAIM FOR PRIORITY

This application claims benefit of priority of United Kingdom Patent Application No. GB 1522249.0, filed Dec. 17, 2015, which is incorporated herein by reference.

TECHNICAL FIELD

The present disclosure relates to a cover assembly, an assembly of containers and a housing.

BACKGROUND

Containers, such as intermodal containers, are widely known to transport goods in a standardized way and are generally used for transportation of goods by marine vessels, trucks or railways. These containers are generally made out of steel, are cuboid shaped, and commonly manufactured in lengths of 20 or 40 feet.

These containers may alternatively be used to create a housing, for example, for assemblies with an engine and a generator. These engine-generator assemblies, also called gensets, may be housed inside one container, or multiple containers that may be positioned around the genset to create the walls of a housing. To protect the genset a roof may be set on top of the walls.

When using such containers as walls for container housings, it may be necessary to cover the gaps between the containers to shield the inside of the containers from weather elements and from animals.

Other features and aspects of this disclosure will be apparent from the following description and the accompanying drawings.

SUMMARY OF THE DISCLOSURE

In a first aspect of the present disclosure a cover assembly to cover a gap between a first container and a second container includes a first rigid element, a second rigid element, an elastic body and a bolt. The elastic body is positioned between the first rigid element and the second rigid element. The bolt connects the first rigid element with the second rigid element.

In another aspect of the present disclosure an assembly of containers includes a first container, a second container and cover assembly. The first container has a first side surface, a front surface and an edge defined by the first side surface and the front surface. The second container has a first side surface, a front surface, a rear surface and an edge defined by the first side surface and the front surface. The first side surface of the first container is closer to the rear surface of the second container as the second side surface of the first container. The first rigid element is positioned at a first side of a gap created by the edge of the first container and the edge of the second container. The second rigid element is positioned on a second side of the gap opposite the first side.

In a third aspect of the disclosure a housing for an engine includes an assembly of containers.

BRIEF DESCRIPTION OF THE DRAWINGS

The accompanying drawings, which are incorporated herein and constitute a part of the specification, illustrate exemplary embodiments of the disclosure and, together with the description, serve to explain the principles of the disclosure. In the drawings.

DETAILED DESCRIPTION

Figure 1:
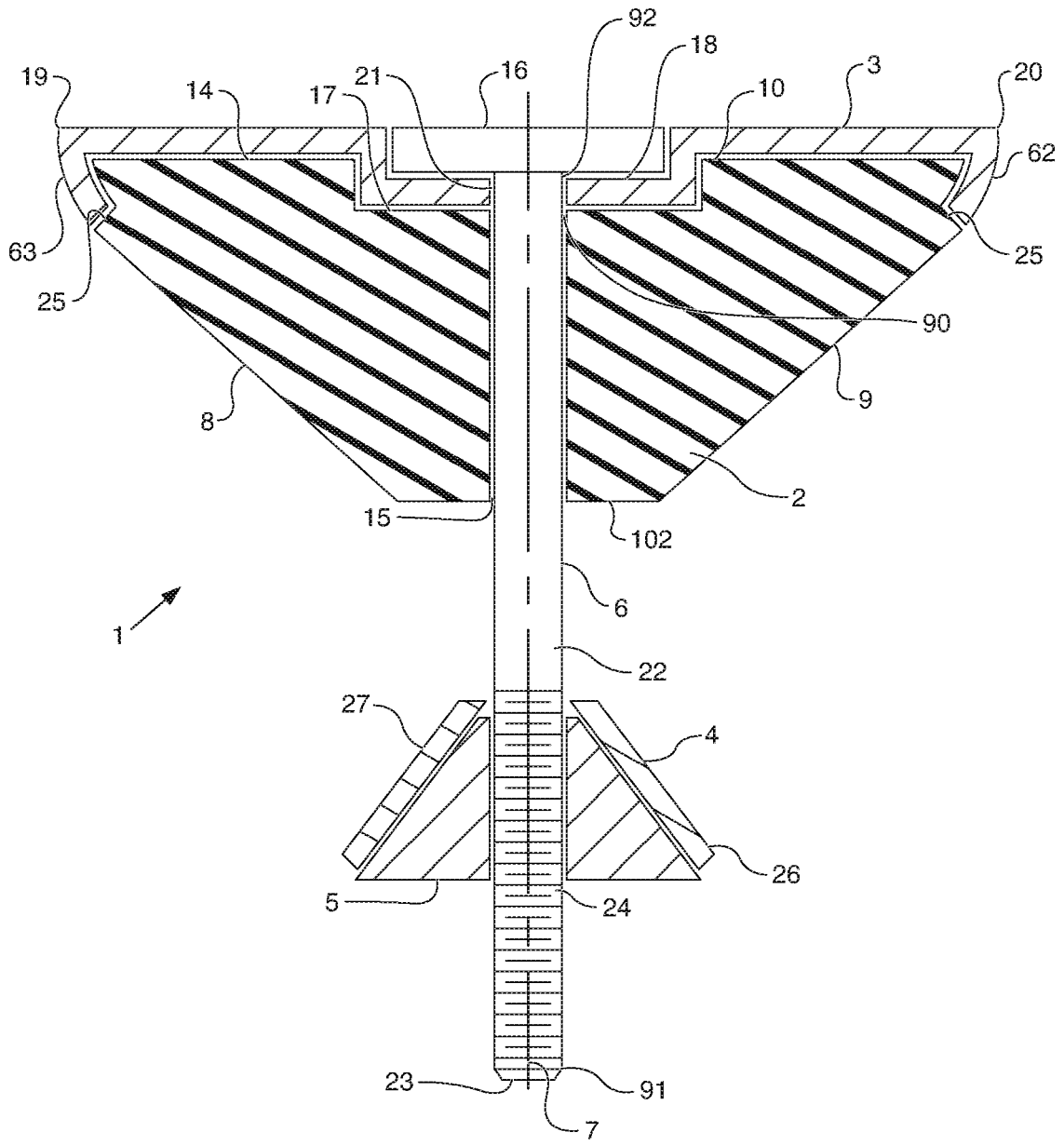
FIG. 1 is a top sectional view of a cover assembly.

The following is a detailed description of exemplary embodiments of the present disclosure. The exemplary embodiments described therein and illustrated in the drawings are intended to teach the principles of the present disclosure, enabling those of ordinary skill in the art to implement and use the present disclosure in many different environments and for many different applications. Therefore, the exemplary embodiments are not intended to be, and should not be considered as, a limiting description of the scope of patent protection. Rather, the scope of patent protection shall be defined by the appended claims.

FIG. 1 shows a cover assembly 1 comprising an elastic body 2, a first rigid element 3, a second rigid element 4, a nut 5 and a bolt 6.

The elastic body 2 may be made of an elastic material like foam, PU-foam, PE-foam, rubber and/or elastic plastic. The elastic body 2 has a generally trapezoid shaped horizontal cross-section in the plane of projection of FIG. 1. This plane may also include a main axis 7 of the cover assembly 1 and bolt 6. "Trapezoid" means in the context of this disclosure a geometric, especially symmetric, shape with side lines 8, 9 inclined to each other. The two first ends of the side lines 8, 9 are connected by a third line 10. The two other ends of the side line 8, 9 may either touch each other or may be connected by a fourth line 102.

Figure 2:
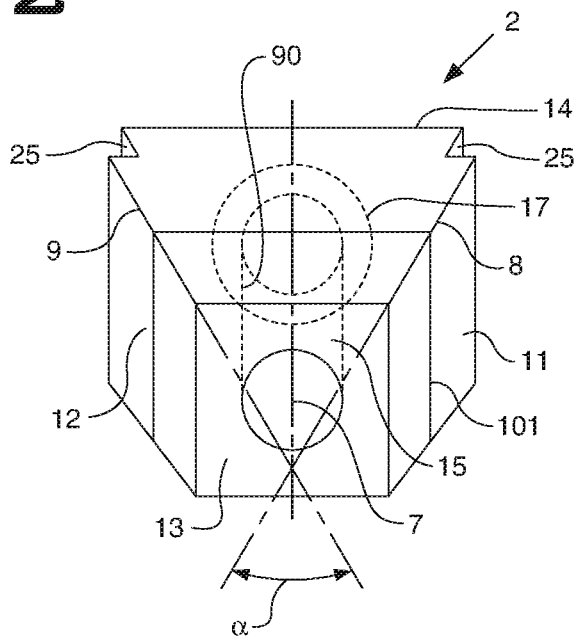
FIG. 2 is a perspective view of an elastic element.

Referring to FIG. 2 the elastic body 2 may have a rectangular vertical cross-section 101, which may be normal to the direction of the main axis 7 of the elastic body 2. A first side surface 11 including the side line 8 and a second side surface 12 including the side line 9 may define an angle alpha which may be between 60 and 120°, for example 90°. A front surface 13 may connect the first side surface 11 and the second side surface 12. In another embodiment the first side surface 11 and the second side surface 12 may converge, defining a top edge (not shown).

A rear surface 14 may connect the first side surface 11 and the second side surface 12. The rear surface 14 may be arranged opposite the front surface 13 or the front edge. One or several bores 15 may extend from the front surface 13 or front edge to the rear surface 14 for example along the main axis 7. The bores 15 may have a constant diameter equal to or slightly larger or smaller than the diameter of the bolt 6. The bores 15 may be arranged in a row. Corresponding to the openings 29 of the second rigid element 4.

Referring to FIG. 1 and FIG. 2 the elastic body 2 may have at the rear surface 14 a recess 17 around a gap 90 of the bore 15 to house a part of the first rigid element 3 and/or a bolt head 16 of the bolt 6. The recess 17 may be circular around the main axis 7 of the elastic body 2 or may be band-shaped and may extend at the rear surface 14 from a lower edge to an upper edge. The recess 17 may be created in an operational state by pressing the first rigid element 3 to the rear surface 14 of the elastic body 2.

The first rigid element 3 may be positioned at the rear surface 14 of the elastic body 2, and may have a flat basic shape. The first rigid element 3 may be made out of metal, like steel, copper and/or iron or a rigid plastic material. The first rigid element 3 may have a recess 18 to house the bolt head 16 of the bolt 6. In in the middle of the recess 18 the elastic body 2 may have an opening 21 which may correspond in diameter to the bolt 6. At outer sides 19, 20 of the first rigid element 3 the first rigid element 3 may be curved towards the elastic body 2 and form embracing elements 62, 63 which engage recesses 25 of the elastic body 2 in a fixed position. The holding recesses 25 of the elastic body 2 may be arranged on the first side surface 11 and the second side surface 12 of the elastic body 2 and may be open towards the rear surface 14 of the elastic body 2.

The first rigid element 3 may have several openings 21, so several bolts 6 may extend through a single rigid element 3. The openings 21 may be positioned in a row corresponding to the row of openings 29 extending through the second rigid element 4.

The first rigid element 2 may be machined from a solid and/or a perforated metal sheet.

The bolt 6 may comprise a cylindrical body 22, which may be at least partly threaded and attached to the bolt head 16. The bolt 6 may be made of metal and/or other hard materials. The bolt 6 may include a tip 23 on an end 91 of the cylindrical body 22. The tip 23 may be flat, pointed or rounded. A threaded portion 24 may be positioned at or near the tip 23 of the bolt 6. At an end 92 of the cylindrical body 22 a bolt head 16 may be attached to the cylindrical body 22 and/or a thread may be positioned at this end to mesh with a thread positioned in the opening 21 of the first rigid element or to place a nut on that end 92 of the bolt 6.

Figure 3:
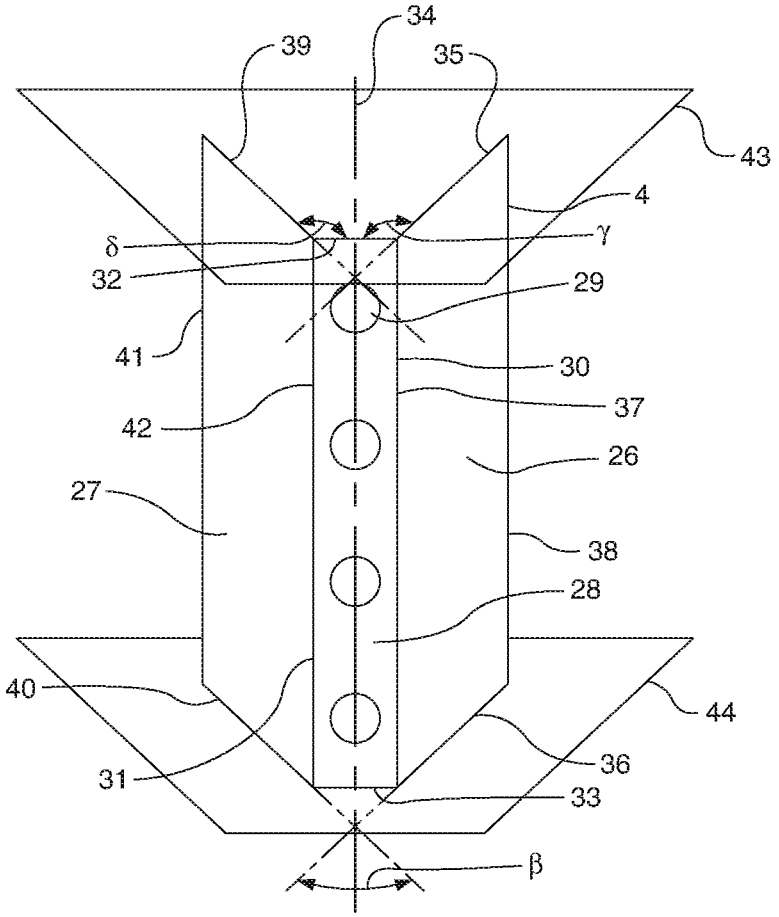
FIG. 3 is a perspective view of a second rigid element.

The second rigid element 4 is shown in detail in FIG. 3. The second rigid element 4 may have a first side sheet 26, a second side sheet 27 and a front sheet 28. The front sheet 28 may have a first side edge 30, a second side edge 31, a top edge 32 and a bottom edge 33. The front sheet 28 may have a rectangular basic shape and one or several openings 29 along a main axis 34 of the front sheet 28. The openings 29 may have a round cross section and the diameter of the openings 29 may correspond to the diameter of the bolt 6.

The first side sheet 26 and the second side sheet 27 of the second rigid element 4 may have a rectangular basic shape. The first side sheet 26 is inclined with respect to the second side sheet 27 defining an angle beta, which may be between 60° and 120°, for example 90°. The first side sheet 26 may have a top edge 35, a bottom edge 36, a first side edge 37 and a second side edge 38. The second side sheet 27 has a top edge 39, a bottom edge 40, a first side edge 41 and the second side edge 42.

The top edge 32 of the front sheet 28 and the top edge 35 of the first side sheet 26 and the top edge 39 of the second side sheet 27 may be arranged in a first common plane 43. The bottom edge 33 of the front sheet 28, the bottom edge 36 of the first side sheet 26 and the bottom edge 40 of the second side sheet 27 may be arranged in a second common plane 44. The first common plane 43 may be parallel to the second common plane 44.

The first side edge 30 of the front sheet 28 is connected to the first side edge 37 of the first side sheet 26. The front sheet 28 may define with the first side sheet 26 an angle gamma, which may be between 90° and 160°, for example around 135°.

The second side edge 31 of the front sheet 28 is connected to the second side edge 42 of the second side sheet 27. The front sheet 28 and the second side sheet 27 may define an angle delta, which may be between 90° and 160°, for example around 135°.

Figure 4:
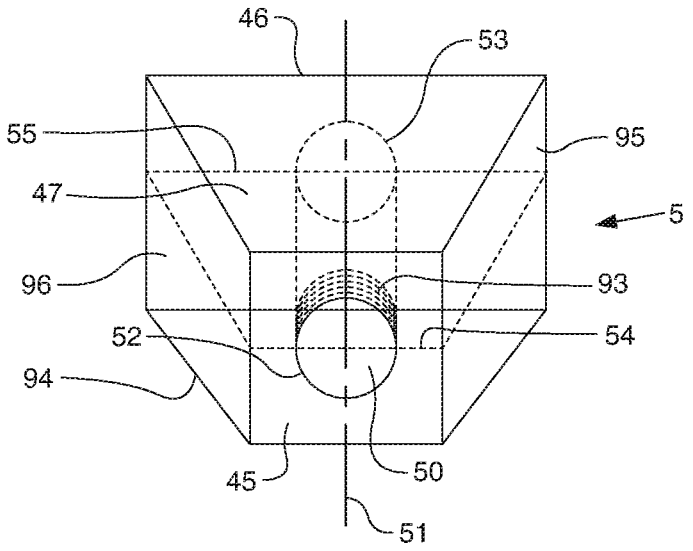
FIG. 4 is a perspective view of a nut.

Referring to FIG. 4 the nut 5 may have a front surface 45, a rear surface 46, an upper surface 47, a lower surface 94, a right surface 95 and a left surface 96. The diameter 54 of the front surface 45 may be larger than the diameter 55 of the rear surface 46. The right surface 95 and the left surface 96 may be inclined to each other and may define an angle of 60° to 120°, for example 90°. The right surface 95 may define an angle of about 90° with the upper surface 47. The right surface 95 may define an angle of about 90° with the lower surface 94. The upper surface 47 may be parallel to the lower surface 94. The left surface 96 may define an angle of about 90° with the upper surface 47. The left surface may define an angle of 90° with the lower surface 94. The front surface 45 may be parallel to the rear surface 46. The nut 5 may have a trapezoid shaped horizontal cross section. The horizontal cross section may be parallel to the upper surface 47.

The nut 5 may have a bore 50 which may extend along the main axis 51 of the nut 5. The bore 50 may have a first opening 52 at the front surface 45 and a second opening 53 at the rear surface 46. The bore 50 may have a diameter corresponding to or slightly larger than the diameter of the bolt 6. A thread 93 may be arranged inside the bore 50 to mesh with the threaded portion 24 of the bolt 6 in an operational state. Alternatively the bore 50 may be formed without a thread 93, so the bolt 6 may move freely in the bore 50. The nut 5 may have one or several bores 50, which may correspond to the openings 29 of the second rigid element 4. The nut 5 may consist of one or several materials, especially metal and/or plastic.

Figure 5:
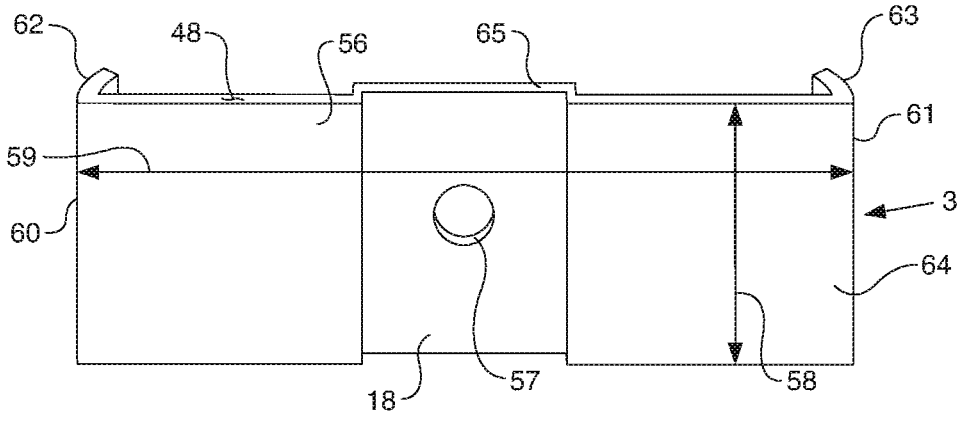
FIG. 5 is a perspective view of a first rigid element.

Referring to FIG. 5 the first rigid element 3 may have a base plate 56, which may basically be rectangular in shape. The base plate 56 may have a smaller width 48 with respect to the height 58 and the length 59 of the base plate 56. The first rigid element 3 may have on both sides 60, 61 fixation means 62, 63, which may embrace the elastic body 2 and connect the first rigid element 3 to the elastic body 2. The fixation means 62, 63 may be formed by bending the ends of the base plate 56 in the direction of the elastic body 2. The first rigid element 3 may have a bore 57 at the base plate 56, the bore 57 corresponding to the bolt 6 in diameter. Alternatively, the bore 57 may have a bigger diameter than the bolt 6.

A recess 18 may be located around the bore 57 in the base plate 56 of the first rigid element 3. The recess 18 may be open to the outer side 64 of the base plate 56. The outer side 64 of the base plate 56 is opposite to an inner side 65 of the base plate 56. The inner side 65 of the base plate 56 faces the elastic body 2 in an operational state. The recess 18 corresponds to or is slightly larger in diameter and depth than the diameter and height of the bolt head 16. The recess 18 may be wide enough to turn the bolt head 16 with a tool.

Figure 6:
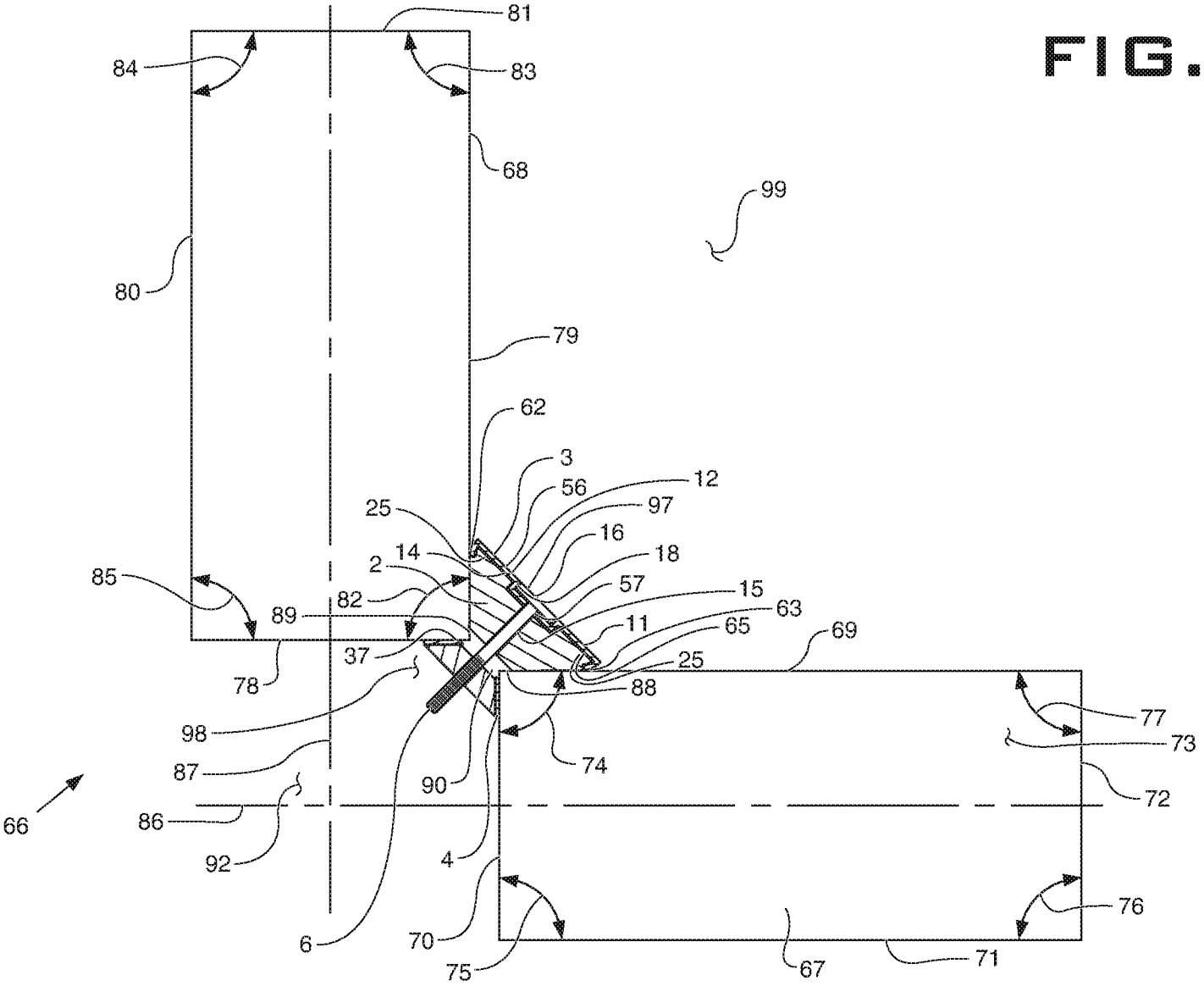
FIG. 6 is a top sectional view of a container assembly.

Referring to FIG. 6 a top sectional view of a container assembly 66 includes a first container 67 and a second container 68. The first container 67 has a first side surface 69, a front surface 70 and a second side surface 71 and a rear surface 72. The front surface 70 may be perpendicular to the first side surface 69 and the second side surface 71. The rear surface 72 may be perpendicular to the first side surface 69 and to the second side surface 71. The front surface 70 may be parallel to the rear surface 72 and the first side surface 69 may be parallel to the second side surface 71. The first container 67 may include a bottom surface (not shown) and a top surface 73. The first side surface 69 defines with the front surface 70 an angle 74, which may be about 90°. The front surface 70 defines with the second side surface 71 an angle 75, which may be about 90°. The second side surface 71 defines with the rear surface 72 an angle 76 of about 90° and the rear surface 72 defines with the first side surface 69 a forth angle 77 of about 90°.

The second container 68 has a front surface 78, a first side surface 79, a second side surface 80 and a rear surface 81. The front surface 78 may be parallel to the rear surface 81 and normal to the first side surface 79 and the second side surface 80. The front surface 78 defines with the first side surface 79 a first angle 82, which may be about 90°. The rear surface 81 defines with the second side surface 80 a third angle 83, which may be about 90°. The second side surface 80 defines with the front surface 78 a forth angle 85, which may be 90°. The first side surface 69 of the first container 67 and the front surface 70 of the first container 67 define a first edge 88. The first side surface 79 of the second container 68 and the front surface 78 of the second container 68 define a first edge 89 of the second container 68.

A gap 90 may be defined by the first edge 88 of the first container 67 and by the first edge 89 of the second container 68. A longitudinal axis 86 of the first container 67 may be perpendicular to a longitudinal axis 87 of the second container 68. The bolt 6 may extend from a first side 97 of the gap 90 to a second side 98 of the gap 90. The first side 97 of the gap 90 may face a first volume 99, which may be defined by the first side surface 79 of the second container 68 and the first side surface 69 of the first container 67. The second side 98 of the gap 90 may face a second volume 100, which may be defined by the front surface 78 of the second container 68 and the front surface 70 of the first container 67. Around the bolt 6 at the side of the first volume 99 the elastic body 2 is arranged. The bolt 6 extends through the bore 15. The first side surface 11 of the elastic body 2 may abut the first side surface 69 of the first container 67. The second side surface 12 of the elastic body 2 may abut the first side surface 79 of the second container 68.

The first rigid element 3 may be arranged around the bolt 6, that the bolt 6 may extend through the bore 57 of the first rigid element 3. The inner side 65 of the base plate 56 of the first rigid element 3 may abut against the rear surface 14 of the elastic body 2 and the fixating means 62 and 63 of the first rigid element 3 may embrace the elastic body 2. The fixation means 62, 63 may rest in the holding recesses 25 of the elastic body 2. A protrusion at the inner side 65 of the base plate 56 opposite to the recess 18 of the first rigid element 3 abuts to the recess 17 of on the elastic body 2. In the recess 18 of the first rigid element 3 the bolt head 16 may be arranged. Alternatively the protrusion of the first rigid element 3 may form the recess 17 in the elastic body by pressing the protrusion into the elastic body 2.

On the second side 98 of on the gap 90 the second rigid element 4 is arranged around the bolt 6. The bolt 6 extends through the opening 29 of the second rigid element 4. On the front sheet 28 of the second rigid element 4 a gap 90 is arranged and the first side sheet 26 of the second rigid element 4 abuts the front surface 78 of the second container 68. The second side sheet 27 of the second rigid element 4 abuts the front surface 70 of the first container 67.

On the side of the front sheet 28 of the second rigid element 4 opposite to the gap 90 the nut 5 is arranged around the bolt 6. The left surface 96 of the nut 5 abuts the inner surface of the second side sheet 27 of the second rigid element 4 and the right surface 95 of the nut 5 abuts the inner surface of the first side sheet 26 of the second rigid element 4. The thread 93 in the bore of the nut 5 may mesh with the thread of the bolt 6.

The elastic body 2, first rigid element 3, the second rigid element 4 and/or the nut 5 may have a length between 30 cm and 4 m, for example 2 m.

INDUSTRIAL APPLICABILITY

Figure 7:
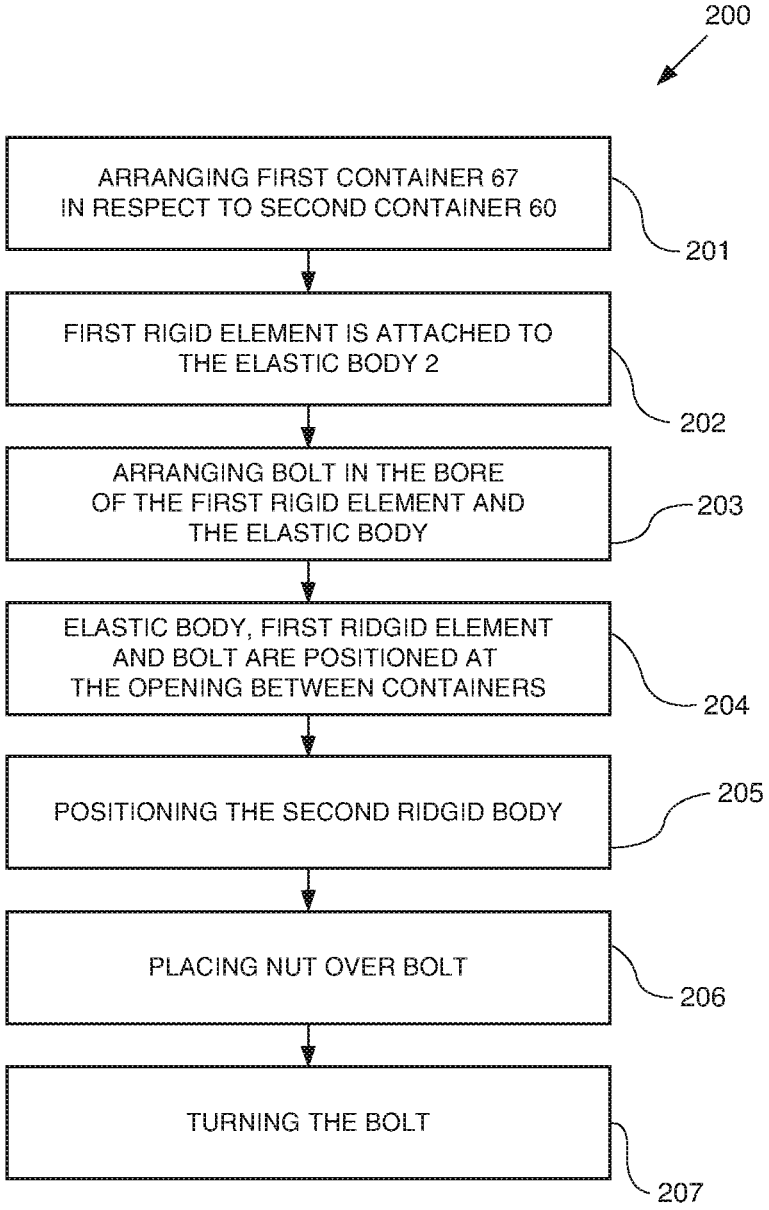
FIG. 7 is a flow chart showing the mounting of the assembly of the cover assembly

The process of assembling and disassembling a cover assembly 1 to a container assembly is described referring to FIG. 6 and FIG. 7.

In a first step 201 the first container is arranged with respect to the second container. By this arrangement the gap is formed between the first edge of the first container and the first edge of the second container.

In a second step 202 the first rigid element is attached to the rear surface of the elastic body. The fixation means are engaged with the side edges of the elastic body.

In a third step 203 the bolt is arranged in the bore of the first rigid element and the bore of the elastic body. The bolt head is positioned in the recess of the first rigid element. The bolt extends out of the bore through an opening at the front surface of the elastic body.

In a fourth step 204 the elastic body, the first rigid element and the bolt are positioned at the gap between the first container and the second container. The bolt extends through the gap.

In a fifth step 205 the second rigid element is positioned at the opposite side of the gap. The bolt is arranged in the opening of the second rigid element. The second rigid element is arranged at the first container and the second container. The first side sheet of the second rigid element 4 abuts the front surface of the second container and the second side sheet of the second rigid element abuts the front surface of the first container.

In a sixth step 206 the nut is placed on the bolt such that the thread in the bore of the nut meshes with the thread of the bolt.

In a seventh step 207 the cover assembly is tightened by turning the bolt. As the thread of the nut meshes with the thread of the bolt the nut is tightened against the second rigid element. The second rigid element is tightened against the front surface of the second container and against the front surface of the first container. The elastic body is compressed by the first rigid element to the first side surface of the first container and the second side surface of the second container.

Alternatively the nut may have not thread and is arranged around the bolt. To create the right pressure between the first rigid element and the second rigid element a threaded nut, which may have a circular or any desired outer shape.

To disassemble the cover assembly, the bolt is turned until the nut, which is held by the second rigid element, disengages with the bolt. The nut may then be removed from the second rigid element and the bolt. After removing the second rigid element from the bolt the first rigid element, the elastic body, and the bolt may be removed from the gap between the first container and the second container.

The invention claimed is:

1. An assembly, comprising:

a cover assembly, including:

a first rigid element disposed on a rear surface of an elastic body, the first rigid element extending from a first side surface of a first container to a first side surface of a second container, the first rigid element including a first embracing element and a second embracing element, the first embracing element oriented to curve toward a first recess in the elastic body, the second embracing element oriented to curve toward a second recess in the elastic body;

a second rigid element that includes a first side surface, a second side surface and a front surface, the front surface disposed between the first side surface and the second side surface of the second rigid element, the front surface including an opening therethrough;

the elastic body that includes a front surface, the rear surface, a bore extending between the front surface and the rear surface of the elastic body, a first side surface that includes the first recess, and a second side surface that includes the second recess, each of the first and second recesses disposed below the rear surface of the elastic body and above the front surface of the elastic body, the elastic body positioned between the first rigid element and the second rigid element; and a bolt, which connects the first rigid element with the second rigid element, disposed in the bore of the elastic body and in the opening of the second rigid element;

a first container including a first side surface, a second side surface, a front surface and an edge defined by the first side surface and the front surface; and a second container spaced apart from the first container, the second container including a first side surface, a front surface, a rear surface and an edge defined by the first side surface and the front surface, wherein:

the first side surface of the first container is positioned closer to the rear surface of the second container than the second side surface of the first container, the first side surface of the first container being at a right angle to the first side surface of the second container;

the first rigid element is positioned at one side of a gap defined by the edge of the first container and the edge of the second container, and the second rigid element is positioned on the opposite side of the gap; and the first embracing element abuts against the first side surface of the first container and the second embracing element abuts against the first side surface of the second container.

2. The assembly of claim 1, wherein a longitudinal axis of the first container and a longitudinal axis of the second container define an angle of 60° to 120°, and the first side surface of the first container is positioned next to the rear surface of the second container, and the first side surface of the first container is aligned with the front surface of the second container.

3. The assembly of claim 1, wherein the first side surface of the second rigid element abuts the front surface of the first container and the second side surface of the second rigid element abuts the front surface of the second container.

4. The assembly of claim 1, wherein the first side surface of the elastic body abuts the first side surface of the first container and the second side surface of the elastic body abuts the first side surface of the second container.

5. The assembly of claim 1, wherein the elastic body comprises a trapezoid shaped cross-section in a plane parallel to a longitudinal axis of the bolt.

6. The assembly of claim 1, wherein the first side surface and the second side surface are each inclined toward the front surface of the second rigid element.

7. The assembly of claim 6, wherein the first rigid element further includes an opening through which the bolt extends.

8. The assembly of claim 6, wherein a trapezoid nut is attached to the bolt.

9. The assembly of claim 1, wherein the first rigid element at least partially encompasses the elastic body.

* * * * *